US010782092B2

(12) United States Patent
Miller

(10) Patent No.: US 10,782,092 B2
(45) Date of Patent: Sep. 22, 2020

(54) HANDGUN BRACE FOR MITIGATING MUZZLE JUMP RECOIL AND PROMOTING PROPER HANDGUN GRIP POSITIONING

(71) Applicant: Richard Lee Miller, Dripping Springs, TX (US)

(72) Inventor: Richard Lee Miller, Dripping Springs, TX (US)

( * ) Notice: Subject to any disclaimer, the term of this patent is extended or adjusted under 35 U.S.C. 154(b) by 0 days.

(21) Appl. No.: 16/508,141

(22) Filed: Jul. 10, 2019

(65) Prior Publication Data

US 2020/0018567 A1 Jan. 16, 2020

Related U.S. Application Data

(60) Provisional application No. 62/696,340, filed on Jul. 11, 2018, provisional application No. 62/872,600, filed on Jul. 10, 2019.

(51) Int. Cl.
*F41C 27/22* (2006.01)

(52) U.S. Cl.
CPC ..... *F41C 27/22* (2013.01)

(58) Field of Classification Search
CPC ..... F41C 27/22; F41A 19/11
USPC ..... 42/1.06, 104
See application file for complete search history.

(56) References Cited

U.S. PATENT DOCUMENTS 1,703,464 A * 2/1929 Wilshire ..... F41A 19/11 42/104
3,758,978 A * 9/1973 Theodore ..... F41A 9/62 42/71.02
4,513,523 A * 4/1985 Gal ..... F41C 23/04 42/72
5,479,736 A 1/1996 Forrester
6,658,781 B1 * 12/2003 Bowen ..... F41C 23/12 42/71.02
2005/0188587 A1 * 9/2005 Danas ..... F41C 23/10 42/72

(Continued)

OTHER PUBLICATIONS

Cross Armory Thumb Grip, Cross Armory, n.d., [online], [retrieved on May 13, 2019]. Retrieved from the Internet <https://crossarmory.com/shop/thumb-grip/>.

(Continued)

*Primary Examiner* — Bret Hayes
(74) *Attorney, Agent, or Firm* — Craig Thompson; Thompson Patent Law

(57) ABSTRACT

Apparatus and associated methods relate to a handgun brace arranged with a rigid structure extending radially away from a handgun trigger guard, and having a forward-facing surface configured to physically engage with at least one finger of a user's non-primary grip hand in a stable position below the handgun's barrel and in front of the handgun's trigger, such that a counter-force applied by the finger(s) at the forward-facing surface tends to prevent the handgun (especially the muzzle), from rising or rotating in response to shooting, such as due to muzzle jump. In an illustrative example, the brace may be releasably fixed to the handgun (e.g., as a modular handgun accessory). A handgun brace that substantially mitigates the unwanted effects of muzzle jump/recoil may advantageously yield higher shooting accuracy and beneficially promote proper handgun grip positioning.

17 Claims, 5 Drawing Sheets

(56) References Cited

U.S. PATENT DOCUMENTS

| | | | | |
|---|---|---|---|---|
| 2012/0131829 | A1 | 5/2012 | Fistikchi et al. | |
| 2017/0205189 | A1* | 7/2017 | Rogers | F41A 19/11 |

OTHER PUBLICATIONS

NcStar Accessory Rail Adapter for M9 Style Airsoft Pistols w/ Trigger Guard Mount, Airsoft Megastore, n.d., [online], [retrieved on May 13, 2019]. Retrieved from the Internet <http://www.airsoftmegastore.com/8201-ncstar-rail-adapter-for-m9-pistols-w-trigger-guard-mount-ncs-madber.aspx>.

RHK111, My Review of the Fab Defense FGG-S-K, rhk111's Firearms Blog, Glock Accessories, Apr. 2, 2013, [online], [retrieved on May 13, 2019]. Retrieved from the Internet <https://rhk111firearmsblog.wordpress.com/2013/04/02/my-review-of-the-fab-defense-fgg-s-k/>.

Beretta 93R, Internet Movie Firearms Database, n.d., [online], [retrieved on May 13, 2019]. Retrieved from the Internet <http://www.imfdb.org/wiki/Beretta_93R>.

LIVIQILY Tactical Pistol Grip Glove Cover Sleeve Anti Slip Hunting Accessories Party Pistol Gun Holster w/Magazine Torch Pouch for Glock 18 19, Amazon, n.d., [online], [retrieved on May 13, 2019]. Retrieved from the Internet <https://www.amazon.com/LIVIQILY-Tactical-Hunting-Accessories-Magazine/dp/B07FZ8QPHG>.

Vertical Forward Grip, Benelli M4, Pistol Grip, Weapon, Gun Accessory PNG, kisspng.com, n.d., [online], [retrieved on May 13, 2019]. Retrieved from the Internet <https://www.kisspng.com/png-vertical-forward-grip-benelli-m4-pistol-grip-handl-3213674/>.

Forward Pistol / Vertical Grip for Italian SITES Spa. Spectre HC & M4 SMG (These are all the new ones that I have left.), MFIAP, n.d., [online], [retrieved on May 13, 2019]. Retrieved from the Internet <https://mfiap.com/i-8592207-forward-pistol-vertical-grip-for-italian-sites-spa-spectre-hc-m4-smg-these-are-all-the-new-ones-that-i-have-left.html>.

Lackmond BCR BGRIP—Beast Hand Held Core Drill Accessory S Back Grip for Bcr 130/5, Amazon, Sep. 6, 2017, [online], [retrieved on May 13, 2019]. Retrieved from the Internet <https://www.amazon.com/Lackmond-BCR-BGRIP-Beast-Accessory/dp/B075FNVD3Z>.

Hot Sale Hand Grip Outdoor Second Generation AFG Angled Foregrip Accessories With Guide Rail for Nerf Toy G un Accessories, AliExpress, n.d., [online], [retrieved on May 13, 2019]. Retrieved from the Internet <https://www.aliexpress.com/i/32951877809.html>.

New Hand Grip Hunting Small Folding Grip Accessories for Nerf Toy G un With Guide Rail Military Tactical Grips, AliExpress, n.d., [online], [retrieved on May 13, 2019]. Retrieved from the Internet <https://www.aliexpress.com/32953830080.html?spm=2114.12057483.0.0.427e31ebS5nzO7>.

ATTACKCOPTERMEDIA, Leapers UTG Debuts New Ultra Slim Handstop in Keymod and M-LOK, ATTACKCOPTER!!!, Nov. 30, 2018, [online], [retrieved on May 13, 2019]. Retrieved from the Internet <https://attackcopter.com/2018/11/30/leapers-utg-debuts-new-ultra-slim-handstop-in-keymod-and-m-lok/>.

M-LOK® Hand Stop Kit, MAGPUL, n.d., [online], [retrieved on May 13, 2019]. Retrieved from the Internet <https://www.magpul.com/products/m-lok-hand-stop-kit>.

Grip Position Support/Handstop—Pack of 2—VTS, Emergency Responder Products, n.d., [online], [retrieved on May 13, 2019]. Retrieved from the Internet <https://www.emergencyresponderproducts.com/grposupaof2v.html?viewfullsite=1>.

Atlas Custom Works M-LOK & Keymod Skeletonized Aluminum Handstop (Choose an Option), AirsoftGI.com, Sep. 17, 2018, [online], [retrieved on May 13, 2019]. Retrieved from the Internet <https://www.airsoftgi.com/product/Atlas-Custom-Works-M-LOK-Keymod-Skeletonized-Aluminum-Handstop-Choose-an-Option-37831/>.

* cited by examiner

HANDGUN BRACE FOR MITIGATING MUZZLE JUMP RECOIL AND PROMOTING PROPER HANDGUN GRIP POSITIONING

CROSS-REFERENCE TO RELATED APPLICATIONS

This application also claims the benefit of U.S. Provisional Application Ser. No. 62/696,340, titled "Handgun Brace," filed by Richard Lee Miller, on Jul. 11, 2018 and U.S. Provisional Application Ser. No. 62/872,600, titled "Handgun Brace," filed by Richard Lee Miller, on Jul. 10, 2019.

This application incorporates the entire contents of the foregoing application(s) herein by reference.

TECHNICAL FIELD

Various embodiments relate generally to handgun and pistol accessories.

BACKGROUND

A handgun is a short-barreled firearm that may be held and used with one hand. Handguns have evolved over time from primitive constructions to more modern designs. For example, hand cannons were developed in in China, where gunpowder was first developed. Later, various types of "lock" handguns were developed, such as matchlock, wheellock, flintlock, and caplock pistols. Types of modern handguns may include revolvers and semi-automatic pistols, for example.

SUMMARY

Apparatus and associated methods relate to a handgun brace arranged with a rigid structure extending radially away from a handgun trigger guard, and having a forward-facing surface configured to physically engage with at least one finger of a user's non-primary grip hand in a stable position below the handgun's barrel and in front of the handgun's trigger, such that a counter-force applied by the finger(s) at the forward-facing surface tends to prevent the handgun (especially the muzzle), from rising or rotating in response to shooting, such as due to muzzle jump. In an illustrative example, the brace may be releasably fixed to the handgun (e.g., as a modular handgun accessory). A handgun brace that substantially mitigates the unwanted effects of muzzle jump/recoil may advantageously yield higher shooting accuracy and beneficially promote proper handgun grip positioning.

Various embodiments may achieve one or more advantages. For example, some embodiments may apply a downward force on the handgun that resists upward muzzle jump. Various examples may substantially increase shooting accuracy for a round that is fired immediately after firing a first round. Some implementations may increase accuracy even more for a rapid-fire succession of rounds. In at least some embodiments, a hand brace may be configured to be removably/releasably coupled to a conventional handgun without adapting the existing handgun. For example, a hand brace may be an addition to an existing handgun, where the brace is added without drilling, welding, or otherwise modifying the existing handgun. Various embodiments may aid a shooter in practicing proper shooting grip and technique.

The details of various embodiments are set forth in the accompanying drawings and the description below. Other features and advantages will be apparent from the description and drawings, and from the claims.

DETAILED DESCRIPTION OF ILLUSTRATIVE EMBODIMENTS

Figure 1:
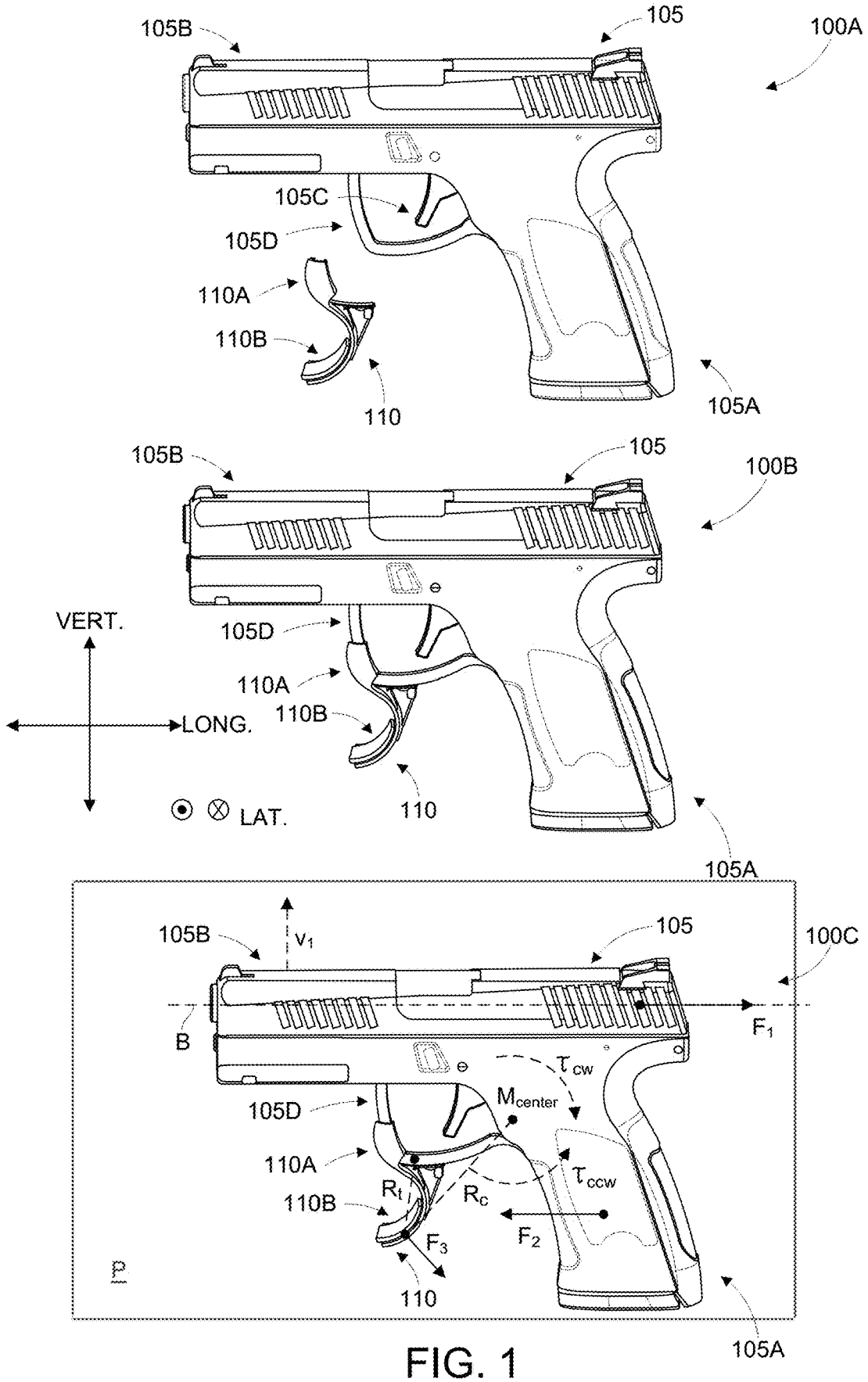
FIG. 1 depicts multiple left side elevational views of an exemplary handgun being fitted with a handgun brace.

FIG. 1 depicts multiple left side elevational views of an exemplary handgun being fitted with a handgun brace. Muzzle jump may refer to a tendency of a firearm's muzzle to be accelerated upward after the firing of the firearm. For many firearms, a bore axis (the longitudinal centerline of the barrel) may be above the firearm's center of mass, while the grip contact point (between the shooter and the gun) may be below the center of mass. So, when a firearm is discharged, bullet motion and the escaping propellant gases may exert a reactional recoil directly backwards along the bore axis, while the countering forward push from a shooter's hands and body is below the bore axis. These combined forces may result in a rotational torque being applied around the center of mass of the firearm, which may cause the firearm to pitch upwards, and the muzzle end to rise. Muzzle jump of a firearm may be more pronounced by the combined recoil resulting from multiple shots being fired in rapid succession. Excessive muzzle jump may be highly undesirable, as it may significantly affect (negatively) the shooting accuracy of a firearm and therefore result in a target being missed/overshot in many situations. Accordingly, disclosed herein is a handgun brace accessory (e.g., handgun brace 110) configured to releasably couple to a handgun (e.g., handgun 105), the handgun brace accessory featuring various mechanical structures that function to substantially mitigate unwanted effects of muzzle jump and recoil for handguns, to advantageously improve shooting accuracy and promote proper handgun grip positioning for a handgun shooter/user.

In FIG. 1, three different states 100A, 100B, and 100C of a handgun and handgun brace assembly are shown. All three states 100A, 100B, 100C include a handgun 105 and a handgun brace 110. In the first state 100A, the handgun 105 and the handgun brace 110 are decoupled from one another. In the second state 100B, the handgun 105 and the handgun brace 110 are operably coupled (mechanically) to one another. In the third state 100C, the handgun 105 and the handgun brace 110 are operably coupled (mechanically) to one another, and the handgun 105 is experiencing (multiple) forces resulting from a discharge/firing of the handgun 105.

As shown in the first state 100A, the handgun 105 includes a handgun grip 105A, a handgun barrel 105B (terminating in a muzzle), a handgun trigger 105C, and a handgun trigger guard 105D. Also shown in the first state 100A is a handgun brace 110 that is decoupled from the handgun 105. The handgun brace 110 includes a handgun coupler 110A configured to mechanically, fixedly, and releasably couple to the handgun 105A. In this exemplary depiction, the handgun coupler 110A mechanically couples to the trigger guard 105D of the handgun 105. A user may mechanically couple the handgun brace 110 to the handgun 105 by fitting (e.g., sliding on) the handgun coupler 110A to the trigger guard 105D, to transition the assembly from the first state 100A into the second state 100B.

The handgun brace 110 further includes a finger engagement surface 110B of a finger engagement member that extends radially away from the trigger guard along a trigger guard radius Rt (shown in the third state 100C at the bottom of FIG. 1). The finger engagement surface 110B is configured to physically and frictionally engage with at least one finger of a non-primary gripping hand of a user/shooter. The phrase "primary gripping hand" refers to the hand of a user that is gripping the actual handgun grip 105A, while the phrase "non-primary gripping hand" refers to the hand of the user that is gripping the handgun brace 110. In an illustrative example, if the shooter is right-handed, then the shooter's right hand (the shooter's primary gripping hand) may grip the grip 105A, while at least one finger of the shooter's left hand (the shooter's non-primary gripping hand or off-hand) may be wrapped around the finger engagement surface 110B. If the user is ambidextrous, the user will still have a primary and a non-primary grip hand—the primary grip is the user's grip on the handgun grip 105A, while the nonprimary grip is the user's grip on the handgun brace 110. The finger engagement surface 110B may therefore provide an additional gripping point for a shooter's non-primary gripping hand that is in close proximity to (and may also partially wrap around) the primary grip point associated with the shooter's primary gripping hand. A dual-grip handgun assembly that employs the handgun brace 110 may therefore provide for two stabilization/anchoring points that may cooperate to substantially mitigate the undesirable forces and effects associated with muzzle jump, as detailed in the third (firing/discharge) state 100C.

As shown in the third state 100C, a dual-grip handgun assembly (including handgun 105 and handgun brace 110) is shown experiencing the forces resulting from a discharge/firing of the handgun 105. A first (backward recoil) force $F_1$ is applied to along the bore axis B of the barrel 105B, as a result of bullet motion and escaping propellant gases exiting through the muzzle of the handgun 105. A second (forward countering) force $F_2$ is a forward push from a shooter's (primary grip) hand around the grip 105A in response to the first/backward force $F_1$, the force $F_2$ being applied below the bore axis B. The net result of the forces $F_1$ and $F_2$ is to cause the handgun 105 to experience a (clockwise) rotational torque $\tau_{cw}$ about a center of mass $M_{center}$ of the handgun 105. Accordingly, the rotational torque $\tau_{cw}$ may cause the firearm to pitch upwards, and the muzzle end of the barrel 105B to rise at an instantaneous velocity $v_i$.

Without the use of the handgun brace 110, repeated shots of the handgun 105 results in successive rotational torque impulses (muzzle jumps) that may rapidly decrease the shooting accuracy of the shooter firing the handgun 105. By employing the handgun brace 110 in cooperation with the handgun 105 however, the finger engagement surface 110B of the handgun brace 110 may provide a third (backwards and downwards) force $F_3$ that may significantly oppose and mitigate the clockwise rotational recoil force $\tau_{cw}$. Specifically, the third force $F_3$ may be applied at a radius $R_c$ from the center of mass of the handgun 105. Therefore, the third force $F_3$ may provide a counter-clockwise counter torque $\tau_{ccw}$ that acts opposite to the recoil torque $\tau_{cw}$ (assuming small or negligible mass of the brace 110 that minimally affects the location of the center of mass $M_{center}$). Accordingly, a user gripping the dual-grip assembly (that employs the handgun brace 110 in cooperation with the handgun 105) may provide a stabilizing counter torque $\tau_{ccw}$ that may yield additional shooting stability and thus higher shooting accuracy for a shooter.

It is worth noting that the terms clockwise and counter-clockwise may be relative terms, which may be used for the purpose of assigning directionality/oppositeness to different rotational vectors. For example, opposite terminology may be used when a handgun is viewed from the right side as opposed to the left side. The terms forward/backward may refer to longitudinal movement or spacing in a forward/backward direction, as oriented by a longitudinal axis LONG. For example, the muzzle of the handgun 105 may be at the "front," while the grip 105A of the handgun 105 may be at the "back/rear." The term lateral may refer to left/right movement or spacing, as oriented by a lateral axis LAT. The term vertical may refer to up/down movement or spacing, as oriented by a vertical axis VERT.

Figure 2:
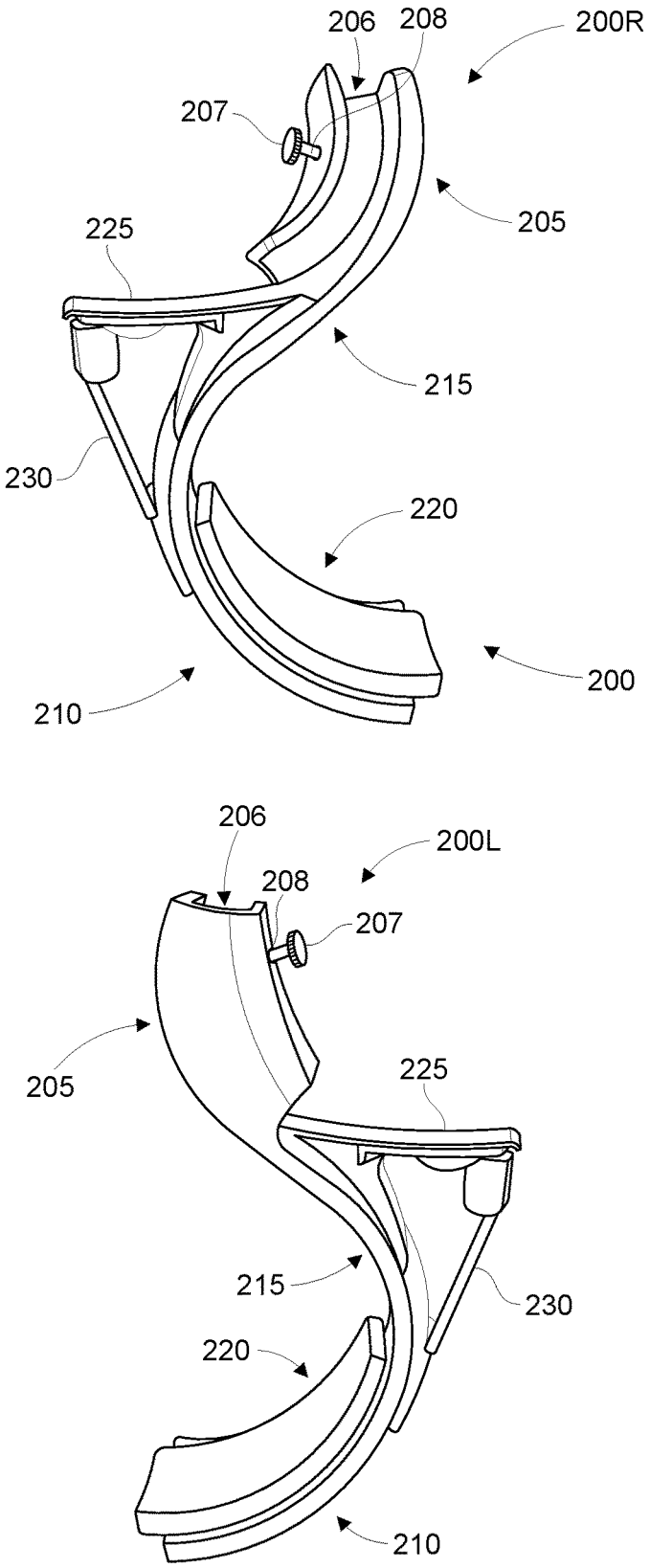
FIG. 2 depicts opposite side elevational views of an exemplary handgun brace.

FIG. 2 depicts opposite side elevational views of an exemplary handgun brace. A handgun brace 200 right side 200R is shown at the top of FIG. 2, and a handgun brace 200 left side 200L is shown at the bottom of FIG. 2. The handgun brace 200 includes a handgun coupler 205. The handgun coupler 205 is configured to mechanically and releasably couple to a handgun, such that the handgun brace is rigidly and fixedly coupled to the handgun when the handgun coupler is operably coupled to the handgun. The handgun brace 200 includes a counter recoil torque member 210. The counter recoil torque member 210 is shown below the handgun coupler 205, and has an at least partially curved cross-sectional profile taken in a vertical and longitudinally extending cross-section (e.g., a vertical plane defined by the LONG and VERT axes shown in FIG. 1). The counter recoil torque member 210 radially extends away from a trigger guard of the handgun (e.g., along the radius $R_t$ in FIG. 1) when the handgun coupler is operably coupled to the handgun. When the handgun coupler 205 is operably coupled to the handgun, the counter recoil torque member 210 may extend along a vertical plane that extends longitudinally along a barrel of a handgun (e.g., the vertical plane P defined by the LONG and VERT axes shown in FIG. 1). The handgun brace 200 includes a rigid bridge 215 that extends from the handgun coupler to the counter recoil torque member. For example, the rigid bridge 215 may be integrally formed with the handgun coupler with the counter recoil torque member 210. The rigid bridge 215 mechanically couples the handgun coupler to the counter recoil torque member to maintains the counter recoil torque member 210 in a fixed spatial relationship relative to the handgun coupler 205. The handgun brace 200 includes a non-primary grip hand engagement surface 220. The surface 220 may be located at a forward-facing surface of the counter recoil torque member 220. The surface is configured to physically engage with at least one finger of a non-primary grip hand of a user (e.g., at least one finger of the shooter's left hand if the shooter is a right-handed shooter). When the handgun coupler 205 is operably coupled to the handgun and the handgun is discharged, the handgun brace 200 is configured to impart a counter-clockwise counter torque to the handgun (e.g., $\tau_{ccw}$ in FIG. 1) resulting from forceable physical engagement between the non-primary grip hand engagement surface 220 and the at least one finger of the non-primary grip hand of a shooter/user, such that the counter-clockwise counter torque at least partially opposes the clockwise recoil torque (e.g., $\tau_{cw}$ in FIG. 1) resulting from the handgun discharge. In some examples, the non-primary grip hand engagement surface 220 may include padding, such as foam padding, to absorb at least some of the recoil impulse experienced by the at least one finger of the non-primary grip hand of a shooter/user at the surface 220.

In the exemplary embodiment of FIG. 2, the handgun coupler 205 functions as a trigger guard coupler configured to directly and mechanically couple the handgun brace 200 to a trigger guard of a handgun when the handgun coupler is operably coupled to the handgun. The handgun coupler 205 includes a slot 206 shaped to receive the trigger guard of the handgun. The slot 206 of the handgun coupler 205 may be slid onto the trigger guard, such that the slot 206 may form an interference or transition fit with the trigger guard, for example. The handgun coupler 205 may include a fastener 207 configured to fixedly and releasably couple the handgun coupler to the handgun. For example, the fastener 207 may be a screw threadably engaged in an aperture 208 of the coupler 205. The screw may be tightened to move a distal end of the screw into compressive physical engagement with the trigger guard to mechanically and fixedly couple the coupler 205 to the trigger guard. The screw may be loosened to move a distal end of the screw out of compressive physical engagement with the trigger guard to release the coupler 205 from the trigger guard.

The handgun brace 200 includes a trigger guard engagement surface 225 located adjacent to the slot 206. The trigger guard engagement surface 225 is configured to physically engage with the trigger guard of the handgun when the handgun coupler 205 is operably coupled to the handgun. The handgun brace 200 includes a secondary bridge 230. The secondary bridge 230 extends from the trigger guard engagement surface 225 to the counter recoil torque member 210 to mechanically couple the trigger guard engagement surface 225 with the counter recoil torque member 210, such that the counter recoil torque member 210 is maintained in a fixed spatial relationship relative to the trigger guard engagement surface 225. Such a construction may advantageously provide additional mechanical stability to a dual-grip handgun assembly.

Figure 3A:
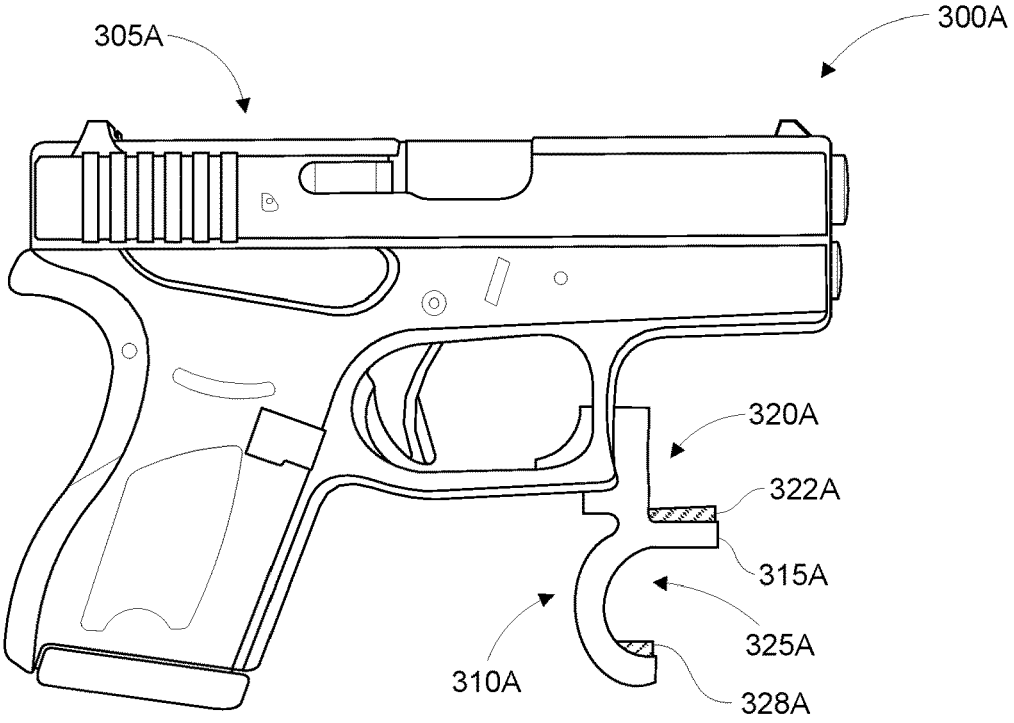
FIGS. 3A and 3B depicts right side elevational views of two exemplary embodiments of handgun braces, each brace being mechanically coupled to an associated exemplary handgun.
Figure 3B:
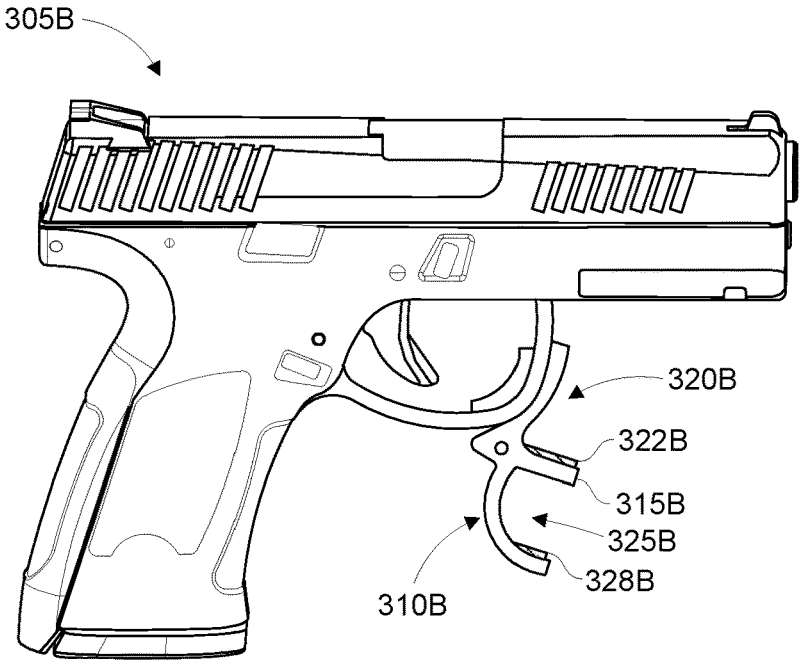

FIGS. 3A and 3B depicts right side elevational views of two exemplary embodiments of handgun braces, each brace being mechanically coupled to an associated exemplary handgun. A first embodiment dual-grip handgun assembly 300A includes a handgun 305A and a handgun brace 310A. The handgun brace 310A includes a forward-protruding finger dividing member 315A that extends horizontally away from the counter recoil torque member 310A. The member 315A defines a first finger engagement surface 320A (and associated padding 322A) located above the member 315A, and a second finger engagement surface 325A (and associated padding 328A) located below the finger dividing member. The surfaces 320A, 325A may provide for additional anchoring and frictional engagement points to increase a user's grip on the handgun brace 300A.

A second embodiment dual-grip handgun assembly 300B includes a handgun 305B and a handgun brace 310B. The handgun brace 310B may be substantially similar to the handgun brace 310A in many respects (e.g., the brace 310B includes a forward-protruding finger dividing member 315B defining a first finger engagement surface 320B (and associated padding 322B), and a second finger engagement surface 325B (and associated padding 328B). However, each brace 310A, 310B may be configured to respectively couple to different handguns 305A, 305B each having differently sized/shaped trigger guards (see discussion below regarding FIGS. 4A and 4B).

Figure 4A:
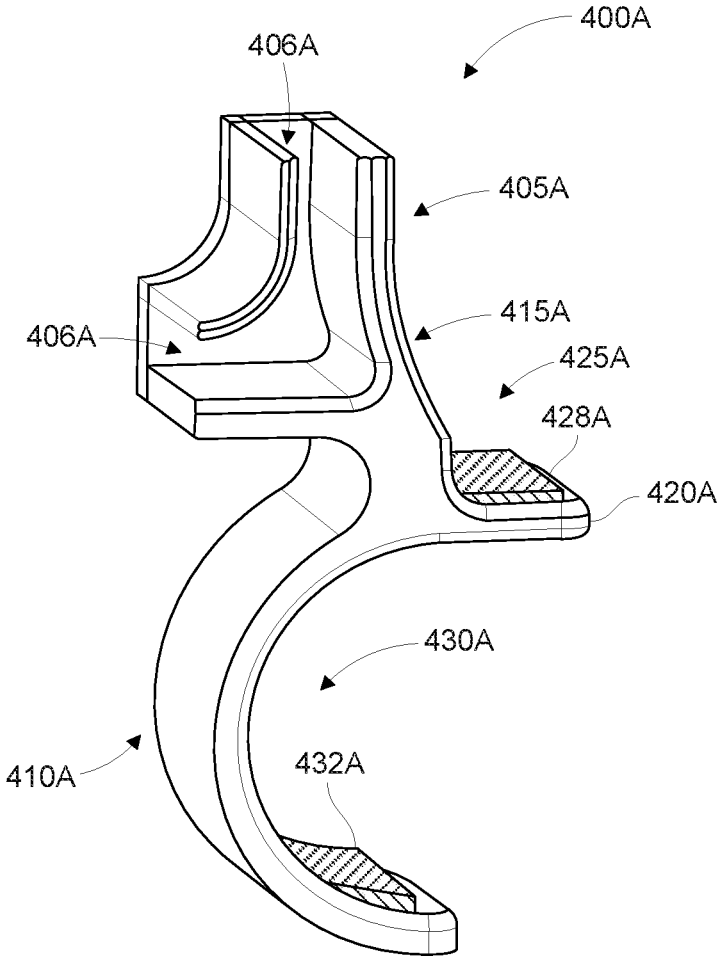
FIGS. 4A and 4B depict top perspective views of two exemplary embodiments of a handgun brace having an exemplary forward-protruding finger dividing member Like reference symbols in the various drawings indicate like elements.
Figure 4B:
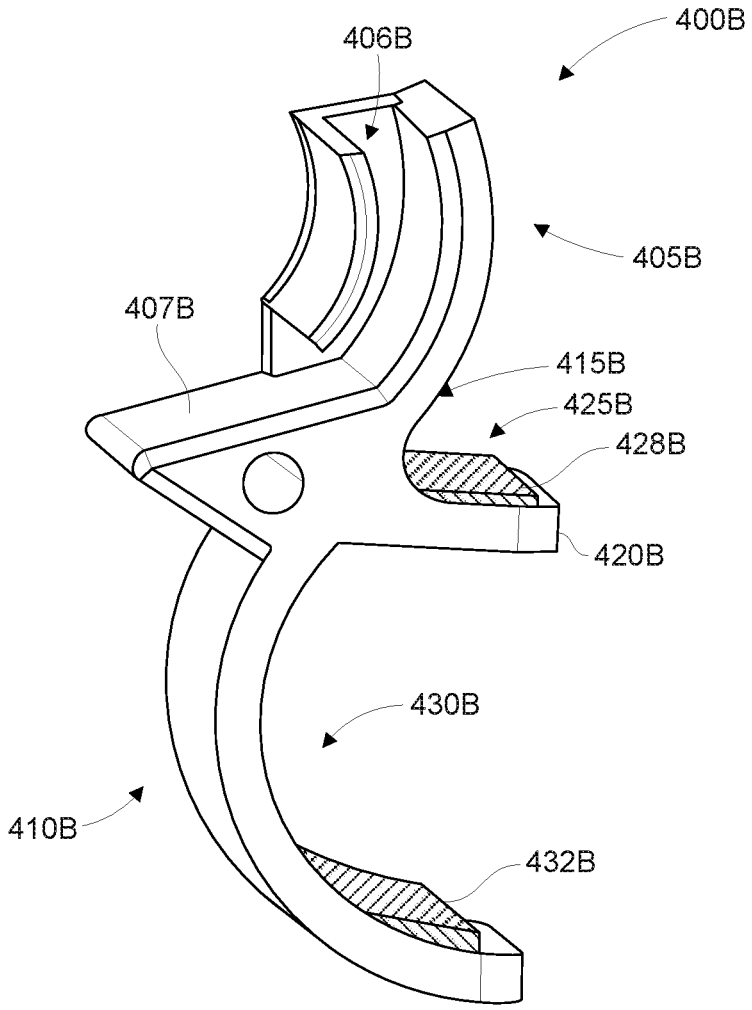

FIGS. 4A and 4B depict top perspective views of two exemplary embodiments of a handgun brace having an exemplary forward-protruding finger dividing member. A first handgun brace 400A includes a handgun coupler 405A having a first dimensioned slot 406A. The handgun brace 400A includes a counter recoil torque member 410A. The counter recoil torque member 410A radially extends away from a trigger guard of a handgun (e.g., along the radius Rt in FIG. 1) when the handgun coupler 405A is operably coupled to the handgun. The handgun brace 400A includes a rigid bridge 415A that extends from the handgun coupler to the counter recoil torque member. The handgun brace 400A includes a forward-protruding finger dividing member 420A that extends horizontally away from the counter recoil torque member 410A. The member 420A defines a first finger engagement surface 425A (and associated padding 428A) located above the member 420A, and a second finger engagement surface 430A (and associated padding 432A) located below the finger dividing member 420A.

A second handgun brace 400B includes a handgun coupler 405B having a second dimensioned slot 406B. The handgun brace 400B includes a trigger guard engagement surface 407B located adjacent to the slot 406B. The handgun brace 400B includes a counter recoil torque member 410B. The counter recoil torque member 410B radially extends away from a trigger guard of a handgun (e.g., along the radius $R_t$ in FIG. 1) when the handgun coupler 405B is operably coupled to the handgun. The handgun brace 400B includes a rigid bridge 415B that extends from the handgun coupler to the counter recoil torque member. The handgun brace 400B includes a forward-protruding finger dividing member 420B that extends horizontally away from the counter recoil torque member 410B. The member 420B defines a first finger engagement surface 425B (and associated padding 428B) located above the member 420B, and a second finger engagement surface 430B (and associated padding 432B) located below the finger dividing member 420A.

Although various embodiments have been described with reference to the Figures, other embodiments are possible. For example, the handgun brace 110 may be integrally formed with the handgun 105. In such embodiments, the handgun 105 may include the handgun brace 110 built into the handgun 105. For example, the brace 110 may be molded or manufactured as an integral component with the handgun 105 (such as being a solid and unitary piece or metal or composite material). In some implementations, the brace 110 may be integrally formed with the trigger guard 105D. In various embodiments, the brace 110 may be welded or cast onto a portion of the handgun 105. In an illustrative example, the brace 110 may be formed as a unitary body with the main body of the handgun 110. In such examples, a user may benefit from a handgun that comes "pre-configured" with an integrated brace 110.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A handgun apparatus comprising:

a handgun brace comprising:

a handgun coupler configured to mechanically and releasably couple to a handgun, such that the handgun brace is rigidly and fixedly coupled to the handgun when the handgun coupler is operably coupled to the handgun, wherein the handgun coupler comprises a trigger guard coupler configured to directly and mechanically couple the handgun brace to a trigger guard of the handgun when the handgun coupler is operably coupled to the handgun;

a counter recoil torque member that radially extends away from the trigger guard of the handgun when the handgun coupler is operably coupled to the handgun, wherein when the handgun coupler is operably coupled to the handgun, the counter recoil torque member extends along a vertical plane that extends longitudinally along a barrel of a handgun;

a rigid bridge that: (1) extends from the handgun coupler to the counter recoil torque member, (2) mechanically couples the handgun coupler with the counter recoil torque member, and (3) and maintains the counter recoil torque member in a fixed spatial relationship relative to the handgun coupler;

a non-primary grip hand engagement surface disposed on a forward-facing surface of the counter recoil torque member, the non-primary grip hand engagement surface being configured to physically engage with at least one finger of a non-primary grip hand of a user; and, a forward-protruding finger dividing member that extends horizontally away from the counter recoil torque member to define a first finger engagement surface disposed above the finger dividing member and a second finger engagement surface disposed below the finger dividing member, wherein when the handgun coupler is operably coupled to the handgun and the handgun is discharged, the handgun brace is configured to impart a counter-clockwise counter torque to the handgun resulting from forceable physical engagement between the non-primary grip hand engagement surface and the at least one finger of the non-primary grip hand of the user, such that the counter-clockwise counter torque at least partially opposes a clockwise recoil torque resulting from the handgun discharge.

2. The handgun apparatus of claim 1, wherein the handgun coupler comprises a fastener configured to fixedly and releasably couple the handgun coupler to the handgun.

3. The handgun apparatus of claim 1, wherein the counter recoil torque member has an at least partially curved cross-sectional profile taken in a vertical and longitudinally extending cross-section.

4. The handgun apparatus of claim 1, wherein the non-primary grip hand engagement surface comprises padding.

5. The handgun apparatus of claim 4, wherein the padding comprises foam padding.

6. The handgun apparatus of claim 1, wherein the first finger engagement surface comprises first padding and the second finger engagement surface comprises second padding.

7. The handgun apparatus of claim 1, wherein the trigger guard coupler comprises a slot shaped to receive the trigger guard of the handgun.

8. The handgun apparatus of claim 1, wherein the handgun brace further comprises a trigger guard engagement surface disposed adjacent to the slot and configured to physically engage with the trigger guard of the handgun when the handgun coupler is operably coupled to the handgun.

9. The handgun apparatus of claim 8, wherein the handgun brace further comprises a secondary bridge that: (1) extends from the trigger guard engagement surface to the counter recoil torque member, (2) mechanically couples the trigger guard engagement surface with the counter recoil torque member, and (3) and maintains the counter recoil torque member in a fixed spatial relationship relative to the trigger guard engagement surface.

10. A handgun apparatus comprising:

a handgun brace comprising:

a handgun coupler configured to mechanically couple to a handgun, such that the handgun brace is rigidly and fixedly coupled to the handgun when the handgun coupler is operably coupled to the handgun;

a counter recoil torque member that radially extends away from a trigger guard of the handgun when the handgun coupler is operably coupled to the handgun, wherein when the handgun coupler is operably coupled to the handgun, the counter recoil torque member extends along a vertical plane that extends longitudinally along a barrel of a handgun;

a rigid bridge that: (1) extends from the handgun coupler to the counter recoil torque member, (2) mechanically couples the handgun coupler with the counter recoil torque member, and (3) and maintains the counter recoil torque member in a fixed spatial relationship relative to the handgun coupler;

a non-primary grip hand engagement surface disposed on a forward-facing surface of the counter recoil torque member, the non-primary grip hand engagement surface being configured to physically engage with at least one finger of a non-primary grip hand of a user; and, a forward-protruding finger dividing member that extends horizontally away from the counter recoil torque member to define a first finger engagement surface disposed above the finger dividing member and a second finger engagement surface disposed below the finger dividing member, wherein when the handgun coupler is operably coupled to the handgun and the handgun is discharged, the handgun brace is configured to impart a counter-clockwise counter torque to the handgun resulting from forceable physical engagement between the non-primary grip hand engagement surface and the at least one finger of the non-primary grip hand of the user, such that the counter-clockwise counter torque at least partially opposes a clockwise recoil torque resulting from the handgun discharge.

11. The handgun apparatus of claim 10, wherein the handgun coupler comprises a fastener configured to fixedly and releasably couple the handgun coupler to the handgun.

12. The handgun apparatus of claim 10, wherein the non-primary grip hand engagement surface comprises padding.

13. The handgun apparatus of claim 10, wherein the first finger engagement surface comprises first padding and the second finger engagement surface comprises second padding.

14. A handgun apparatus comprising:

a handgun; and, a handgun brace comprising:

a handgun coupler configured to mechanically couple to the handgun, such that the handgun brace is rigidly and fixedly coupled to the handgun when the handgun coupler is operably coupled to the handgun;

a counter recoil torque member that radially extends away from a trigger guard of the handgun when the handgun coupler is operably coupled to the handgun, wherein when the handgun coupler is operably coupled to the handgun, the counter recoil torque member extends along a vertical plane that extends longitudinally along a barrel of a handgun;

a rigid bridge that: (1) extends from the handgun coupler to the counter recoil torque member, (2) mechanically couples the handgun coupler with the counter recoil torque member, and (3) and maintains the counter recoil torque member in a fixed spatial relationship relative to the handgun coupler;

a non-primary grip hand engagement surface disposed on a forward-facing surface of the counter recoil torque member, the non-primary grip hand engagement surface being configured to physically engage with at least one finger of a non-primary grip hand of a user; and, a forward-protruding finger dividing member that extends horizontally away from the counter recoil torque member to define a first finger engagement surface disposed above the finger dividing member and a second finger engagement surface disposed below the finger dividing member, wherein when the handgun coupler is operably coupled to the handgun and the handgun is discharged, the handgun brace is configured to impart a counter-clockwise counter torque to the handgun resulting from forceable physical engagement between the non-primary grip hand engagement surface and the at least one finger of the non-primary grip hand of the user, such that the counter-clockwise counter torque at least partially opposes a clockwise recoil torque resulting from the handgun discharge.

15. The handgun apparatus of claim 14, wherein the handgun coupler is releasably coupled to the handgun when the handgun coupler is operably coupled to the handgun.

16. The handgun apparatus of claim 14, wherein the handgun brace is integrally and unitarily formed with the handgun.

17. The handgun apparatus of claim 14, wherein the non-primary grip hand engagement surface comprises padding.

* * * * *